US010269476B2

(12) United States Patent
Kodama et al.

(10) Patent No.: US 10,269,476 B2
(45) **Date of Patent: *Apr. 23, 2019**

(54) METHOD OF MANUFACTURING AN AMORPHOUS ALLOY MAGNETIC CORE

(71) Applicant: HITACHI METALS, LTD., Minato-ku, Tokyo (JP)

(72) Inventors: Hitoshi Kodama, Yasugi (JP); Kengo Takahashi, Yasugi (JP); Daichi Azuma, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/513,991

(22) PCT Filed: Sep. 24, 2015

(86) PCT No.: PCT/JP2015/076999
§ 371 (c)(1),
(2) Date: Mar. 24, 2017

(87) PCT Pub. No.: WO2016/047718
PCT Pub. Date: Mar. 31, 2016

(65) Prior Publication Data

US 2017/0294255 A1 Oct. 12, 2017

(30) Foreign Application Priority Data

Sep. 26, 2014 (JP) ..... 2014-197345

(51) Int. Cl.
*H01F 7/06* (2006.01)
*H01F 1/153* (2006.01)
(Continued)

(52) U.S. Cl.
CPC ..... *H01F 1/15308* (2013.01); *C22C 45/02* (2013.01); *H01F 3/04* (2013.01);
(Continued)

(58) Field of Classification Search
CPC ..... C22C 45/02; H01F 1/15308; H01F 3/04; H01F 27/25; H01F 41/0226
See application file for complete search history.

(56) References Cited

U.S. PATENT DOCUMENTS 6,710,693 B2 * 3/2004 Matsumoto ..... H01F 3/10 336/110
2009/0189728 A1 7/2009 Fukui et al.
2017/0294267 A1 * 10/2017 Kodama ..... H01F 1/153

FOREIGN PATENT DOCUMENTS

JP S48-16306 U 2/1973
JP S52-615 U 1/1977
(Continued)

OTHER PUBLICATIONS

English language translation of the following: Office action dated Mar. 20, 2018 from the SIPO in a Chinese patent application No. 201580051982.X corresponding to the instant patent application. This office action translation is submitted now in order to supplement the understanding of the cited reference which is being disclosed in the instant Information Disclosure Statement.

*Primary Examiner* — Paul D Kim
(74) *Attorney, Agent, or Firm* — SOLARIS Intellectual Property Group, PLLC

(57) ABSTRACT

An amorphous alloy magnetic core including a layered body in which amorphous alloy thin strips are layered one on another, the layered body having one end face and another end face in a width direction of the amorphous alloy thin strips, an inner peripheral surface and an outer peripheral surface orthogonal to a layering direction of the amorphous alloy thin strips, and a hole passing through from a part of
(Continued)

the one end face as a starting point, the width direction corresponding to a depth direction of the hole.

3 Claims, 9 Drawing Sheets

(51) Int. Cl.

| | |
|---|---|
| ***C22C 45/02*** | (2006.01) |
| ***H01F 3/04*** | (2006.01) |
| ***H01F 41/02*** | (2006.01) |
| ***H01F 27/25*** | (2006.01) |

(52) U.S. Cl.
CPC ..... *H01F 27/25* (2013.01); *H01F 41/0226* (2013.01); *H01F 1/153* (2013.01)

(56) References Cited

FOREIGN PATENT DOCUMENTS

| | | | |
|---|---|---|---|
| JP | S60-169117 | A | 9/1985 |
| JP | S61-180410 | A | 8/1986 |
| JP | H06-346219 | A | 12/1994 |
| JP | H07-9858 | B2 | 2/1995 |
| JP | 2001-510508 | A | 7/2001 |
| JP | 2001-338823 | A | 12/2001 |
| JP | 2007-234714 | A | 9/2007 |
| JP | 2012-223052 | A | 11/2012 |

* cited by examiner

METHOD OF MANUFACTURING AN AMORPHOUS ALLOY MAGNETIC CORE

TECHNICAL FIELD

The present invention relates to an amorphous alloy magnetic core and a method of manufacturing the same.

BACKGROUND ART

Amorphous alloys have been employed as a material for a magnetic core (core) of a transformer for power distribution, a transformer for electronic and electric circuit, and the like since they exhibit excellent magnetic properties.

Magnetic cores made of amorphous alloys (hereinafter, referred to as the "amorphous alloy magnetic core") can suppress the loss of electric current at the time of no load to about ⅓ as compared to magnetic cores made of silicon steel plates (electromagnetic steel plate), and they have been thus expected as a magnetic core adaptable to energy saving in recent years.

An amorphous alloy thin strip (amorphous alloy ribbon) to be used in fabrication of amorphous alloy magnetic cores is manufactured by discharging a molten alloy onto a cooling roll that is made of a copper alloy and rotates from a nozzle by a single roll method and rapidly cooling the molten alloy.

The amorphous alloy magnetic cores are often subjected to a heat treatment after being fabricated by layering amorphous alloy thin strips one on another in order to impart proper magnetic properties to the amorphous alloy magnetic cores.

For example, Japanese Patent Application Laid-Open (JP-A) No. 2007-234714 discloses the relation between the heat treatment temperature of an amorphous alloy magnetic core and the iron loss (core loss) or Hc (coercive force) of the amorphous alloy magnetic core.

In addition, Japanese National-Phase Publication (JP-A) No. 2001-510508 discloses the relation between the heat treatment temperature of an amorphous alloy magnetic core and the apparent power of the amorphous alloy magnetic core.

SUMMARY OF INVENTION

Technical Problem

As disclosed above, it is important to subject the amorphous alloy magnetic core to a heat treatment under a proper heat treatment condition in order to impart proper magnetic properties to the amorphous alloy magnetic core.

However, there is a problem in the conventional amorphous alloy magnetic core that it is difficult or cumbersome to optimize the heat treatment condition. The reason for this is that the internal temperature profile of the magnetic core is not often consistent with the surface temperature profile of the magnetic core during the heat treatment. Hence, the final heat treatment condition has been hitherto often determined by repeating the adjustment of the heat treatment condition while confirming the relation between the heat treatment condition and the magnetic properties actually obtained.

The invention has been made in view of the above circumstances, and it aims to achieve the following object.

That is, an object of the invention is to provide an amorphous alloy magnetic core for which the heat treatment condition is easily optimized and a method of manufacturing the same.

Solution to Problem

Specific means for achieving the above object is as follows.

<1> An amorphous alloy magnetic core including a layered body in which amorphous alloy thin strips are layered one on another, the layered body having one end face and another end face in a width direction of the amorphous alloy thin strips, an inner peripheral surface and an outer peripheral surface orthogonal to a layering direction of the amorphous alloy thin strips, and a hole passing through from a part of the one end face as a starting point, the width direction corresponding to a depth direction of the hole.

<2> The amorphous alloy magnetic core according to <1>, wherein a shortest distance between a center of the hole and a center line in a thickness direction of the layered body is 10% or less with respect to a thickness of the layered body, when viewed from a side of the one end face in the layered body.

<3> The amorphous alloy magnetic core according to <1> or <2>, wherein the entire hole is included in a range from one end to another end in a longitudinal direction of the inner peripheral surface on the one end face, when viewed from a side of the one end face in the layered body.

<4> The amorphous alloy magnetic core according to any one of <1> to <3>, wherein a shortest distance between a center of the hole and a center line in a longitudinal direction of the layered body is 20% or less with respect to a length in the longitudinal direction of the layered body, when viewed from a side of the one end face in the layered body.

<5> The amorphous alloy magnetic core according to any one of <1> to <4>, wherein a depth of the hole is from 30% to 70% with respect to a distance between the one end face and the another end face.

<6> The amorphous alloy magnetic core according to any one of <1> to <5>, wherein a width of the hole is 1.5 mm or more in the layered body.

<7> The amorphous alloy magnetic core according to any one of <1> to <6>, wherein a width of the hole is narrower than a value calculated by a mathematical formula $T\times(100-LF)/100$, wherein a thickness (mm) of the layered body is denoted as T and a space factor (%) of the amorphous alloy magnetic core is denoted as LF in the layered body.

<8> The amorphous alloy magnetic core according to any one of <1> to <7>, wherein a width of the hole is 3.5 mm or less in the layered body.

<9> The amorphous alloy magnetic core according to any one of <1> to <8>, wherein the hole is a hole for inserting a temperature measuring unit therein.

<10> The amorphous alloy magnetic core according to any one of <1> to <9>, wherein the hole is a hole for inserting a temperature measuring unit therein.

<11> The amorphous alloy magnetic core according to any one of <1> to <10>, further comprising a resin layer which blocks the hole and covers at least a part of the one end face of the layered body.

<12> A method of manufacturing an amorphous alloy magnetic core, the method including:

a layered body preparing step of preparing a layered body by layering amorphous alloy thin strips one on another, the layered body having one end face and another end face in a width direction of the amorphous alloy thin strips and an inner peripheral surface and an outer peripheral surface orthogonal to a layering direction of the amorphous alloy thin strips; and a hole forming step of forming a hole passing through from the one end face of the layered body as a starting point, the width direction corresponding to a depth direction of the hole.

<13> The method of manufacturing an amorphous alloy magnetic core according to <12>, the method further including:

a heat treatment step of subjecting the layered body, after being subjected to the hole forming step, to a heat treatment while measuring an internal temperature of the hole.

<14> The method of manufacturing an amorphous alloy magnetic core according to <13>, the method further including:

a resin layer forming step of forming a resin layer which blocks the hole and covers at least a part of the one end face of the layered body after being subjected to the heat treatment step.

Advantageous Effects of Invention

According to the invention, an amorphous alloy magnetic core for which the heat treatment condition is easily optimized and a method of manufacturing the same are provided.

DESCRIPTION OF EMBODIMENTS

Figure 1:
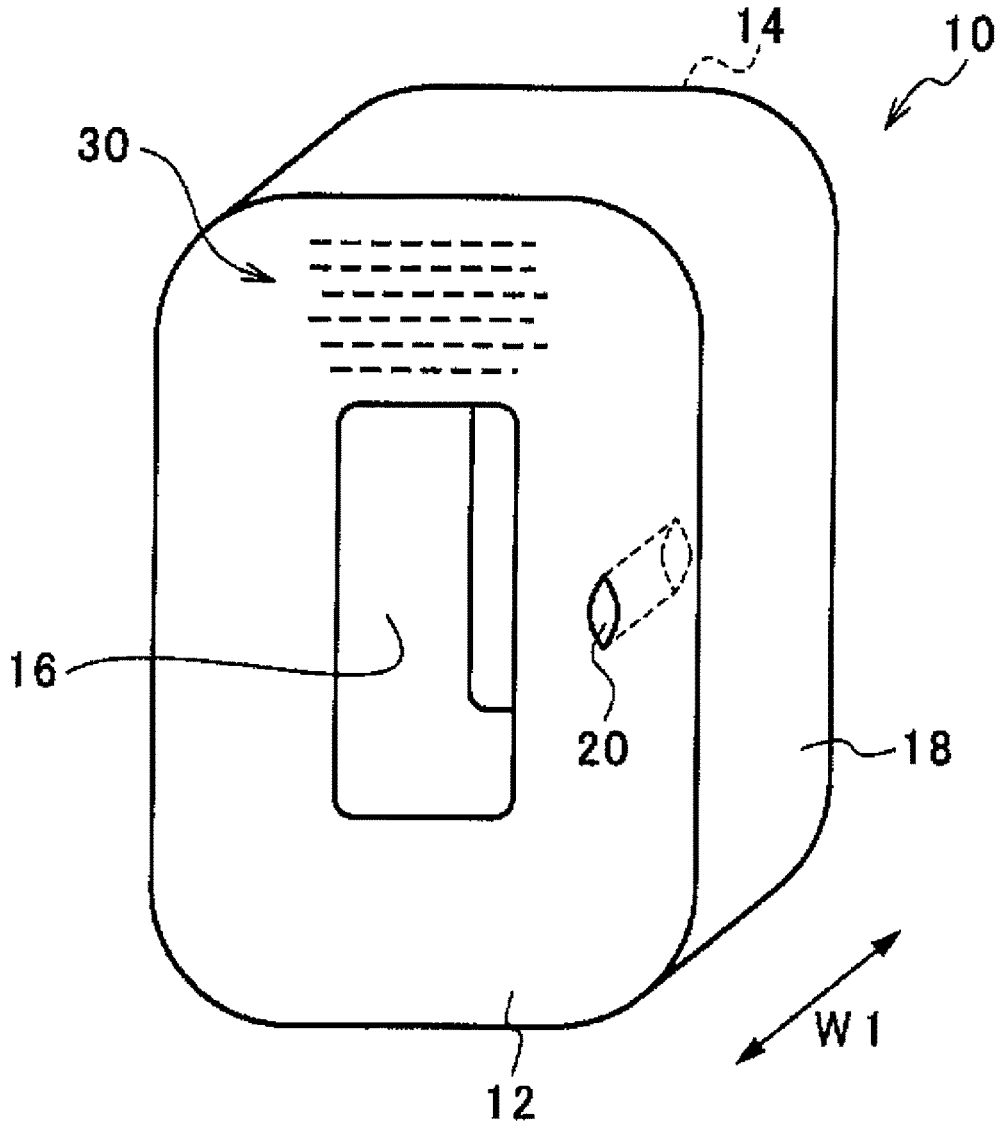
FIG. 1 is a schematic perspective view of a core (layered body) according to a first embodiment.

Hereinafter, an amorphous alloy magnetic core and a method of manufacturing the amorphous alloy magnetic core according to the invention will be described in detail.

In the present specification, the numerical range indicated by using "to" means a range including the numerical values described before and after "to" as the minimum value and the maximum value, respectively.

In the present specification, the unit "rpm" is an abbreviation for round per minute.

In the present specification, the term "step" includes not only an independent step but also a step by which the intended purpose of the step is achieved although it is not clearly distinguished from other steps.

<Amorphous Alloy Magnetic Core>

The amorphous alloy magnetic core (hereinafter, also simply referred to as the "magnetic core" or "core") of the invention is equipped with a layered body which is formed by layering amorphous alloy thin strips (hereinafter, also simply referred to as the "thin strips" or "ribbons") one on another, the layered body having one end face and another end face in a width direction of the amorphous alloy thin strips and an inner peripheral surface and an outer peripheral surface orthogonal to a layering direction of the amorphous alloy thin strips, and a hole passing through from the one end face of the layered body as a starting point, the width direction corresponding to a depth direction of the hole.

The magnetic core (core) of the invention may be equipped with members (resin layer, silicon steel plate, and the like to be described later) other than the layered body if necessary.

There has been a problem in the conventional amorphous alloy magnetic core that it is difficult or cumbersome to optimize the heat treatment condition. The reason for this is the internal temperature profile of the magnetic core is not often consistent with the surface temperature profile of the magnetic core during the heat treatment. Hence, the final heat treatment condition has been hitherto often determined by repeating the adjustment of the heat treatment condition while confirming the relation between the heat treatment condition and the magnetic properties actually obtained.

With regard to the above problem, the magnetic core of the invention includes the hole, and this makes it possible to accurately measure the internal temperature profile of the magnetic core during the heat treatment for imparting magnetic properties by inserting a temperature measuring unit (hereinafter, also referred to as the "thermocouple or the like") such as a thermocouple or a temperature sensor into the hole. Moreover, it is possible to easily adjust (optimize) the heat treatment condition while confirming the internal temperature profile of the magnetic core.

Consequently, according to the magnetic core of the invention, it is possible to easily optimize the heat treatment condition thereof.

According to the magnetic core of the invention, it is possible to easily adjust (optimize) the heat treatment condition while confirming the internal temperature profile of the individual cores, for example, even in the case of deciding the common heat treatment condition for magnetic cores having different sizes or in the case of deciding the heat treatment condition for conducting the heat treatment of a plurality of magnetic cores in the same heat treating furnace.

The magnetic core of the invention may be a magnetic core before being subjected to a heat treatment or a magnetic core after being subjected to a heat treatment.

In a case in which the magnetic core of the invention is a magnetic core before being subjected to a heat treatment, there is an effect that the condition for the heat treatment (heat treatment condition) to be conducted later can easily be optimized.

In a case in which the magnetic core of the invention is a magnetic core after being subjected to a heat treatment, there is an effect that it can be manufactured by using a magnetic core for which the heat treatment condition is easily optimized and which is provided with a hole.

In addition, in the magnetic core provided with a hole of the invention, distortion newly occurs and the magnetic properties thus deteriorate when it is attempted to block the hole by deforming the layered body after the heat treatment. Hence, it is preferable that the hole on the magnetic core of the invention be left as a hole even after the heat treatment.

The hole of the invention is preferably provided at a position at which the temperature is greatly different from that of the surface of the magnetic core. The position at which the temperature is greatly different from that of the surface of the magnetic core can be determined, for example, by simulation taking thermal conduction into consideration.

Hereinafter, a preferred aspect of the magnetic core of the invention (preferred aspect of the position of the hole, and the like) will be described.

It is preferable that the magnetic core of the invention is configured such that a shortest distance between a center of the hole and a center line (for example, the center line C1 in FIG. 2) in a thickness direction of the layered body is 10% or less with respect to a thickness of the layered body, when viewed from a side of the one end face in the magnetic core.

In short, it is preferable to provide the hole at the center in the thickness direction of the layered body or in the vicinity thereof.

This makes it possible to measure the temperature of a place at which the temperature is greatly different from that of the surface (for example, the outer peripheral surface and the inner peripheral surface) of the magnetic core in the interior of the magnetic core, and it is thus easier to optimize the heat treatment condition.

In the present specification, the thickness direction of the layered body refers to the thickness direction of the thin strips; in other words, the layering direction of the thin strips.

Figure 2:
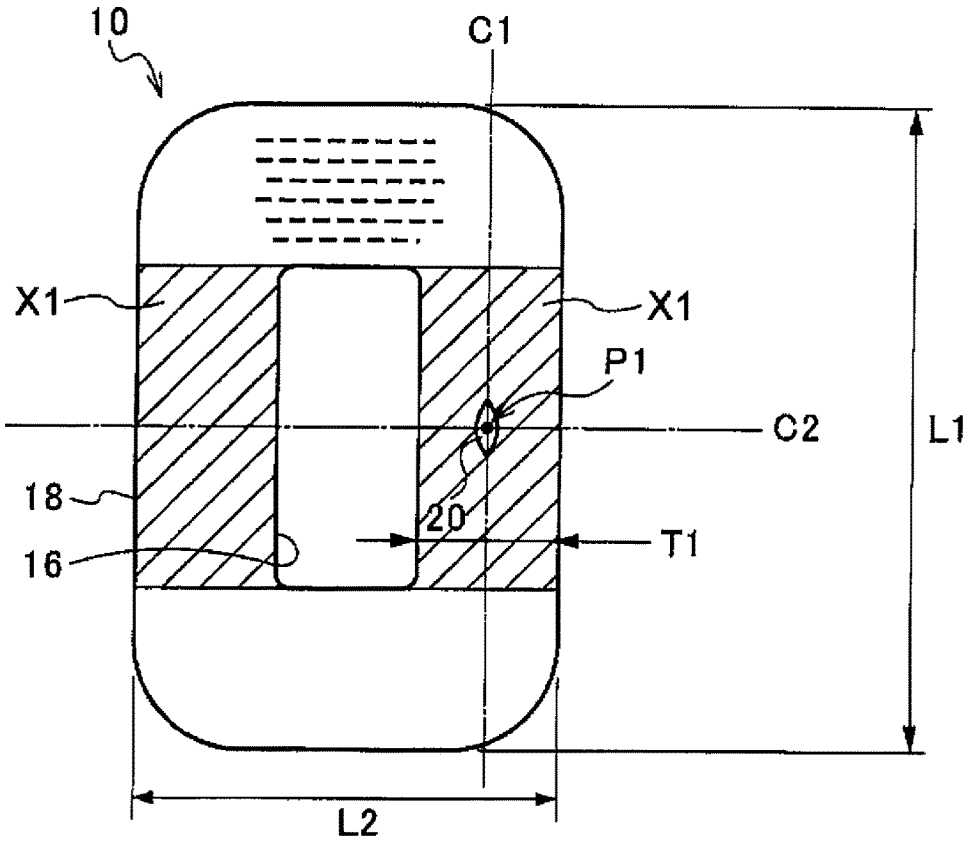
FIG. 2 is a schematic plan view of a core (layered body) according to a first embodiment.

That is, the thickness of the layered body refers to the total thickness of the layered thin strips (that is, layered thickness of the thin strips) (for example, the thickness T1 in FIG. 2).

In addition, it is preferable that the magnetic core of the invention is configured such that the entire hole is included in a range (for example, the range X1 indicated by an oblique line in FIG. 2) from one end to another end in a longitudinal direction of the inner peripheral surface on the one end face, when viewed from a side of the one end face in the layered body.

Here, the "range from one end to another end in a longitudinal direction of the inner peripheral surface on the one end face" refers to the range from a straight line which passes through one end in the longitudinal direction of the inner peripheral surface and is orthogonal to this longitudinal direction to a straight which passes another end in the longitudinal direction of the inner peripheral surface and is orthogonal to this longitudinal direction on the one end face.

In addition, it is also preferable that the magnetic core of the invention is configured such that a shortest distance between a center of the hole and a center line (for example, the center line C2 in FIG. 2) in a longitudinal direction of the layered body is 20% or less (more preferably 10% or less and still more preferably 5% or less) with respect to a length (for example, the long side length L1 in FIG. 2) in the longitudinal direction of the layered body, when viewed from a side of the one end face in the layered body.

In addition, it is preferable that the magnetic core of the invention is configured such that a depth (for example, the depth Dh in FIG. 4) of the hole is from 30% to 70% with respect to a distance (for example, the distance D1 in FIG. 4) between the one end face and the another end face in the layered body.

In short, it is preferable that the bottom of the hole exist at the midpoint between the one end face and the another end face or in the vicinity thereof.

This makes it possible to measure the temperature of a place at which the temperature is greatly different from that of the surface (specifically one end face and another end face) of the magnetic core in the interior of the magnetic core and it is thus easier to optimize the heat treatment condition.

In addition, it is preferable that the magnetic core of the invention is configured such that a width of the hole is 1.5 mm or more in the magnetic core.

This makes it easier to insert a thermocouple or the like into the hole. Furthermore, it is possible to further decrease the friction when the thermocouple or the like is taken out from the hole.

Figure 3:
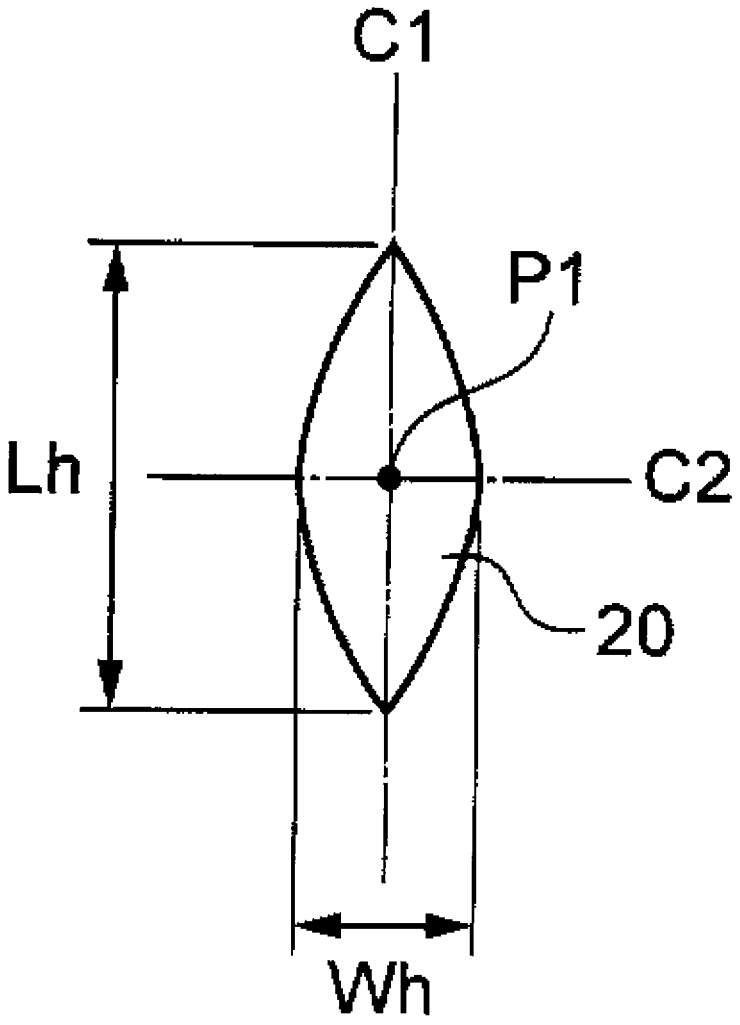
FIG. 3 is a partially enlarged view of FIG. 2.

Incidentally, in the present specification, the width of the hole means the maximum width of the hole (the maximum value of the length in the width direction of the hole; for example, the width Wh in FIG. 3) when viewed from the side of the one end face.

In the layered body, the width of the hole preferably corresponds to the length in the thickness direction of the layered body of the hole (for example, see FIG. 2).

In addition, it is preferable that the magnetic core of the invention is configured such that a width of the hole is narrower than a value to be calculated by a mathematical formula $T\times(100-LF)/100$, wherein a thickness (mm) of the layered body is denoted as T and a space factor (%) of the amorphous alloy magnetic core is denoted as LF in the layered body.

The value to be calculated by the mathematical formula $T\times(100-LF)/100$ is the sum of the widths of the gaps between the thin strips included between the inner peripheral surface and the outer peripheral surface.

The volume of deformation of the thin strips caused by providing the hole can be absorbed by the gap between the thin strips as the width of the hole is narrower than the value to be calculated by the mathematical formula $T\times(100-LF)/100$. Hence, it is possible to suppress deformation of the outer shape of the layered body (the outer peripheral surface and the inner peripheral surface, the same applies hereinafter) caused by providing the hole.

The width of the hole is preferably less than the value to be calculated by a mathematical formula $(T\times(100-LF)/100)/2$ from the viewpoint of further suppressing the deformation of the outer shape of the layered body caused by providing the hole.

In addition, it is preferable that the magnetic core of the invention is configured such that a width of the hole is 3.5 mm or less and more preferably 3.0 mm or less in the magnetic core.

It is possible to suppress deformation of the outer shape of the layered body caused by providing the hole as the width of the hole is 3.5 mm or less.

The width of the hole is still more preferably from 1.5 mm to 3.5 mm, still more preferably from 1.5 mm to 3.0 mm, and particularly preferably from 2.0 mm to 3.0 mm.

In addition, it is preferable that the magnetic core of the invention is configured such that a length of the hole is from 1.5 mm to 35 mm in the magnetic core.

It is easier to insert a thermocouple or the like into the hole when the length of the hole is 1.5 mm or more. Furthermore, it is possible to further decrease the friction when the thermocouple or the like is taken out from the hole.

Meanwhile, it is possible to further suppress a decrease in magnetic properties of the magnetic core caused by providing the hole when the length of the hole is 35 mm or less.

The length of the hole is more preferably from 5 mm to 35 mm and particularly preferably from 10 mm to 30 mm.

Incidentally, in the present specification, the length of the hole means the maximum length of the hole (the maximum value of the length in the longitudinal direction of the hole; for example, the length Lh in FIG. 3) when viewed from the side of one end face.

In addition, in the present specification, the length of the hole and the width of the hole satisfy the relation that the length of the hole≥the width of the hole although it is needless to say.

In addition, the hole is preferably a hole for temperature measuring unit (thermocouple or the like) insertion as described above.

This makes it easier to optimize the heat treatment condition.

In addition, in the magnetic core of the invention, the thickness of the layered body (layered thickness of the thin strips) is preferably from 10 mm to 300 mm and more preferably from 10 mm to 200 mm.

In addition, in the manufacturing method of the invention, the space factor of the layered body is preferably 85% or more. The upper limit of the space factor of the layered body is ideally 100%, but the upper limit may be 95% or 90%.

Here, the space factor (%) refers to the value determined based on the thickness of the thin strips, the number of thin strips layered, and the thickness of the layered body (for example, the thickness T1 in FIG. 2).

In addition, it is preferable that the magnetic core of the invention be further equipped with a resin layer which blocks the hole and covers at least a part of the one end face of the layered body.

By such a resin layer, it is possible to flatten one end face (in particular, irregularities in the layering direction of the thin strip). Furthermore, scattering of the crushed powder from the hole can be suppressed by the resin layer even in a case in which a crushed powder of the amorphous alloy is generated in the hole in the course of formation of the hole.

The resin layer mentioned here plays its role as long as it blocks the entrance of the hole. Scattering of the crushed powder is suppressed as long as the resin layer blocks the entrance of the hole. In other words, it is not required that the entire hole (the total volume of the hole) is necessarily filled with the resin.

In addition, the magnetic core of the invention may be equipped with a silicon steel plate in contact with the inner peripheral surface (hereinafter, referred to as the "inner peripheral surface side silicon steel plate") on the further inner side of the inner peripheral surface (namely, the inner peripheral surface of the innermost peripheral thin strip) of the layered body. An aspect equipped with a silicon steel plate on the further inner side of the inner peripheral surface has advantages of being able to improve the strength of the magnetic core, being easy to maintain the shape of the magnetic core, and the like.

In addition, the magnetic core may be equipped with a silicon steel plate in contact with the outer peripheral surface (hereinafter, referred to as the "outer peripheral surface side silicon steel plate") on the further outer side of the outer peripheral surface (namely, the outer peripheral surface of the outermost peripheral thin strip) of the layered body.

An aspect equipped with a silicon steel plate on the further outer side of the outer peripheral surface has advantages of being able to improve the strength of the magnetic core, being easy to maintain the shape of the magnetic core, and the like.

These silicon steel plates may be a nondirectional silicon steel plate or a directional silicon steel plate.

The thickness of these silicon steel plates is not particularly limited, and the thickness of a general silicon steel plate may be mentioned.

The thickness of these silicon steel plates is preferably from 0.2 mm to 0.4 mm.

Hereinafter, embodiments of the magnetic core of the invention will be described with reference to the drawings, but the invention is not limited to the following embodiments. In addition, the same reference numerals may be attached to elements common to the respective drawings, and redundant explanation may be omitted.

First Embodiment

The magnetic core according to the first embodiment is one that is classified as a magnetic core called a "single-phase core" (or "single-phase bipod core").

Figure 4:
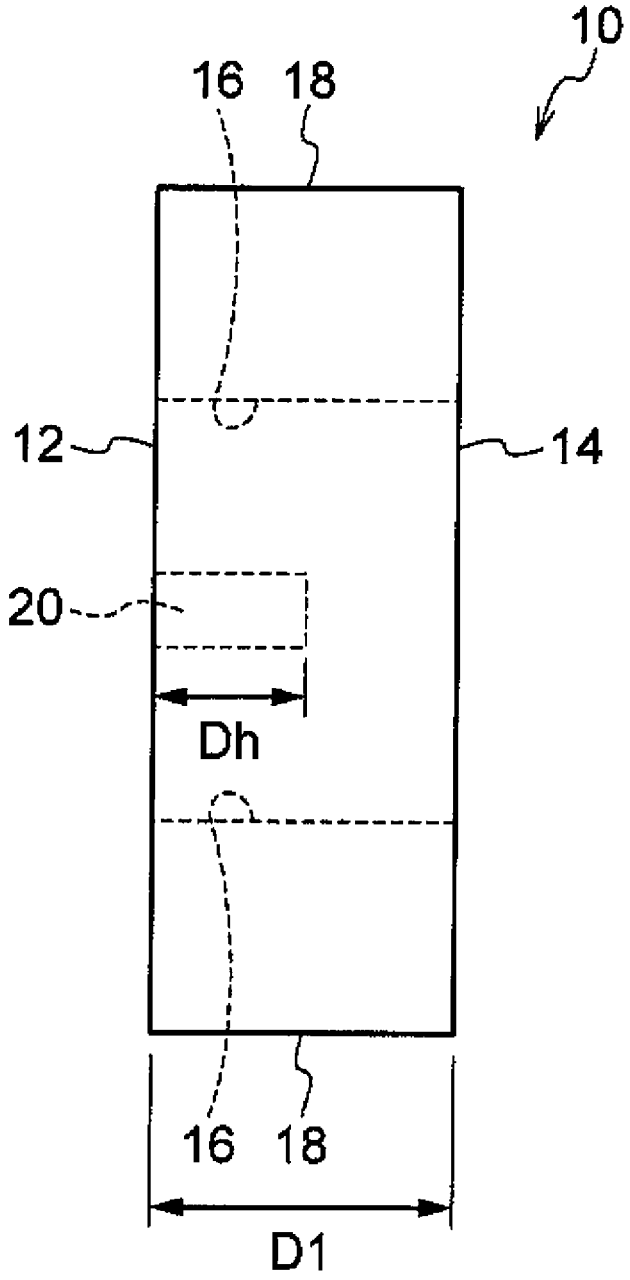
FIG. 4 is a schematic side view of a core (layered body) according to a first embodiment.

FIG. 1 is a schematic perspective view of the magnetic core (layered body) according to the first embodiment of the invention, FIG. 2 is a schematic plan view of the magnetic core (layered body) according to the first embodiment, and FIG. 4 is a schematic side view of the magnetic core (layered body) according to the first embodiment.

As illustrated in FIG. 1 and FIG. 4, a layered body 10 of the magnetic core according to the first embodiment is a layered body which has a rectangular annular shape (tubular shape), and which is formed by layering an amorphous alloy thin strips one on another (the layered structure is not illustrated), and has one end face 12 and another end face 14 which are in the width direction W1 of the amorphous alloy thin strips and an inner peripheral surface 16 and an outer peripheral surface 18 which are orthogonal to the layering direction of the amorphous alloy thin strips. In the layered body 10, an overlap portion 30 is a portion at which both end portions in the longitudinal direction of the individual thin strips overlap each other.

Incidentally, the "rectangle" referred to here is not limited to a shape in which the four corners are not rounded and includes a shape in which the four corners are rounded (having a radius of curvature) as the layered body 10.

In addition, the shape of the layered body in the invention is not limited to a rectangular annular shape (tubular shape), and it may be an elliptical (including circular) annular shape (tubular shape).

A hold 20 which passes through from a part of the one end face 12 as the starting point and the width direction W1 corresponds to the depth direction of the hole is provided on the layered body 10.

By conducting the heat treatment of the layered body 10 in a state in which a thermocouple or the like is inserted in the hole 20, it is possible to accurately measure the internal temperature profile of the hold 20 (namely, the internal temperature profile of the layered body) in the course of the heat treatment. This makes it possible to easily optimize the heat treatment condition.

FIG. 3 is a partially enlarged view of FIG. 2, and it is a view illustrating the enlarged hole 20.

As illustrated in FIG. 2 and FIG. 3, the shape of the hold 20 is a shape which has the longitudinal direction of the thin strips as the longitudinal direction, of which the central portion in the longitudinal direction is swollen, and both end portions in the longitudinal direction are pointed. However, the shape of the hole of the invention is not limited to the shape of the hole 20, and it may be any shape such as an elliptical shape (including a circular shape), a rhombus shape, or a rectangular shape.

In addition, as illustrated in FIG. 2 and FIG. 3, in the layered body 10, the hold 20 is provided on the center line C1 in the thickness direction (the direction of the thickness T1) of the layered body.

The position on the center line C1 is a position farthest from the outer peripheral surface 18 and inner peripheral surface 16 of the layered body 10 and a place at which the temperature is greatly different from those of the outer peripheral surface 18 and the inner peripheral surface 16. It is particularly effective to provide the hold 20 at this position in order to measure the internal temperature of the layered body 10 (that is, the internal of the magnetic core). By providing the hold 20 at this position, it is possible to accurately measure the internal temperature profile of the layered body 10 (that is, the internal of the magnetic core) in the course of the heat treatment. This makes it easier to optimize the heat treatment condition.

However, the hold 20 is not necessarily provided on the center line C1. For example, it is possible to obtain approximately the same effect as in the case of providing the hold 20 on the center line C1 when the shortest distance between the center P1 of the hold 20 and the center line C1 is 10% or less (preferably 5% or less) with respect to the thickness T1 of the layered body.

In addition, as illustrated in FIG. 2 and FIG. 3, in the layered body 10, the hold 20 is provided on the center line C2 in the longitudinal direction of the layered body 10.

The position on the center line C2 is a position farthest from both ends in the longitudinal direction of the layered body 10 (long side direction), and a place at which the temperature is greatly different from those of these both ends. It is also particularly effective to provide the hold 20 at this position in order to measure the internal temperature of the layered body 10 (namely, the internal of the magnetic core). By providing the hold 20 at this position, it is possible to accurately measure the internal temperature profile of the layered body 10 (namely, the internal of the magnetic core) in the course of the heat treatment. This makes it easier to optimize the heat treatment condition.

Incidentally, the hold 20 is not necessarily provided on the center line C2, but it is preferable that the entire hold 20 be included in a range (a range X1 indicated by an oblique line in FIG. 2) from one end to another end in the longitudinal direction of the inner peripheral surface 16 on the one end face 12 when viewed from the side of the one end face 12. In addition, the shortest distance between the center P1 of the hold 20 and the center line C2 is 20% or less (more preferably 10% or less and still more preferably 5% or less) with respect to the long side length L1 (length in the longitudinal direction of the layered body 10) of the layered body 10.

In addition, as illustrated in FIG. 4, the depth Dh of the hold 20 is half (50%) of the distance D1 between one end face 12 and another end face 14 (namely, the width of the thin strip). The position to be 50% of the distance D1 is a position farthest from one end face 12 and the another end face 14 of the layered body 10 and a place at which the temperature is greatly different from those of one end face 12 and another end face 14. It is also particularly effective to set the depth Dh of the hold 20 to this depth in order to measure the internal temperature of the layered body 10 (namely, the internal of the magnetic core). By setting the depth Dh of the hold 20 to this depth, it is possible to accurately measure the internal temperature profile of the layered body 10 (namely, the internal of the magnetic core) in the course of the heat treatment. This makes it easier to optimize the heat treatment condition.

However, the depth Dh of the hold 20 is not necessarily 50% of the distance D1. For example, it is possible to obtain approximately the same effect as in the case of setting the depth Dh to be 50% of the distance D1 when the depth Dh of the hold 20 is from 30% to 70% (more preferably from 40% to 60%) of the distance D1.

In addition, the width of the hold 20 (the width Wh of the hole in FIG. 3) viewed from the side of the one end face 12 is not particularly limited, but the width Wh is preferably 1.5 mm or more as described above.

As described above, the width Wh is preferably narrower than the value to be calculated by the mathematical formula $T\times(100-LF)/100$ (more preferably narrower than the value to be calculated by the mathematical formula $(T\times(100-LF)/100)/2$.

Incidentally, T (thickness of the layered body) in these mathematical formulas is the thickness T1 in the first embodiment and the thickness T11 in the second embodiment to be described later.

As described above, the width Wh is preferably 3.5 mm or less and more preferably 3.0 mm or less.

In addition, the length of the hold 20 (the length Lh of the hole in FIG. 3) viewed from the side of the one end face 12 is not particularly limited, but the hole length Lh is preferably from 1.5 mm to 35 mm, more preferably from 5 mm to 35 mm, and particularly preferably from 10 mm to 30 mm as described above.

Incidentally, in the layered body 10, only one hole passing through from the one end face 12 as the starting point is provided, but the layered body in the invention is not limited to this form. In addition, the number of holes in the layered body may be two or more. In the layered body, not only a hole passing through from the one end face as the starting point but also a hole passing through from another end face as the starting point may be provided.

The thickness T1 of the layered body 10 is preferably from 10 mm to 300 mm, more preferably from 10 mm to 200 mm, more preferably from 20 mm to 150 mm, and particularly preferably from 40 mm to 100 mm.

The long side length L1 (the length in the longitudinal direction) of the layered body 10 is preferably from 250 mm to 1400 mm and more preferably from 260 mm to 450 mm.

The short side length L2 (the length in the direction orthogonal to the longitudinal direction) of the layered body 10 is preferably from 80 mm to 800 mm and more preferably from 160 mm to 250 mm.

The material for the amorphous alloy thin strips in the layered body 10 is not particularly limited, and a known amorphous alloy such as an Fe-based amorphous alloy, a Ni-based amorphous alloy, or a CoCr-based amorphous alloy can be used.

Examples of the known amorphous alloy may include an Fe-based amorphous alloy, a Ni-based amorphous alloy, and a CoCr-based amorphous alloy which are described in paragraphs 0044 to 0049 of International Publication No. 2013/137117.

As the material for the amorphous alloy thin strips in the invention, an Fe-based amorphous alloy is particularly preferable.

As the Fe-based amorphous alloy, an Fe—Si—B containing amorphous alloy and an Fe—Si—B—C containing amorphous alloy are more preferable.

As the Fe—Si—B containing amorphous alloy, an alloy having a composition in which Si is contained at from 2 atomic % to 13 atomic %, B is contained at from 8 atomic % to 16 atomic %, and Fe and inevitable impurities are substantially contained as the balance is preferable.

In addition, as the Fe—Si—B—C containing amorphous alloy, an alloy having a composition in which Si is contained at from 2 atomic % to 13 atomic %, B is contained at from 8 atomic % to 16 atomic %, C is contained at 3 atomic % or less, and Fe and inevitable impurities are contained as the balance is preferable.

In any cases, a case in which Si is 10 atomic % or less and B is 17 atomic % or less is preferable from the viewpoint of a high saturation magnetic flux density Bs. In addition, in the Fe—Si—B—C containing amorphous alloy thin strip, it is preferable that the amount of C be 0.5 atomic % or less since the secular change is great when C is excessively added.

In addition, the thickness of the amorphous alloy thin strip (the thickness of one thin strip) is preferably from 15 μm to 40 μm, more preferably from 20 μm to 30 μm, and particularly preferably from 23 μm to 27 μm.

It is advantageous that the thickness of the thin strip is 15 μm or more from the viewpoint of being able to maintain the mechanical strength of the thin strip and of increasing the space factor so as to decrease the number of layers in the case of being layered.

In addition, it is advantageous that the thickness of the thin strip is 40 μm or less from the viewpoint of suppressing the eddy current loss low, of being able to decrease the bending strain when being processed into a layered magnetic core, and further of being likely to stably obtain an amorphous phase.

In addition, the width of the amorphous alloy thin strip (the length in the direction orthogonal to the longitudinal direction of the thin strip) is preferably from 15 mm to 250 mm.

A large-capacity magnetic core is likely to be obtained when the width of the thin strip is 15 mm or more.

In addition, a thin strip exhibiting high plate thickness uniformity in the width direction is likely to be obtained when the width of the thin strip is 250 mm or less.

Among them, the width of the thin strip is more preferably from 50 mm to 220 mm, still more preferably from 100 mm to 220 mm, and still more preferably from 130 mm to 220 mm from the viewpoint of obtaining a large-capacity and practical magnetic core. Among them, the width of the thin strip is particularly preferably 142±1 mm, 170±1 mm, and 213±1 mm of the width of a thin strip that is standardly used.

The manufacture of the amorphous alloy thin strip can be conducted, for example, by a known method such as a liquid quenching method (a single roll method, a twin roll method, a centrifugal method, and the like). Among them, the single roll method is a manufacturing method which requires a relatively simple manufacturing facility and can stably manufacture the amorphous alloy thin strip, and has excellent industrial productivity.

For the method of manufacturing an amorphous alloy thin strip by the single roll method, it is possible to appropriately see, for example, the descriptions of Japanese Patent No. 3494371, Japanese Patent No. 3594123, Japanese Patent No. 4244123, Japanese Patent No. 4529106, and International Publication No. 2013/137117.

In addition, the magnetic core according to the first embodiment may be equipped with members other than the layered body 10.

For example, the magnetic core according to the first embodiment may be equipped with a composite of the layered body 10 and at least either of the inner peripheral surface side silicon steel plate (silicon steel plate in contact with the inner peripheral surface of the innermost peripheral thin strip) described above or the outer peripheral surface side silicon steel plate (silicon steel plate in contact with the outer peripheral surface of the outermost peripheral thin strip) described above.

Figure 5:
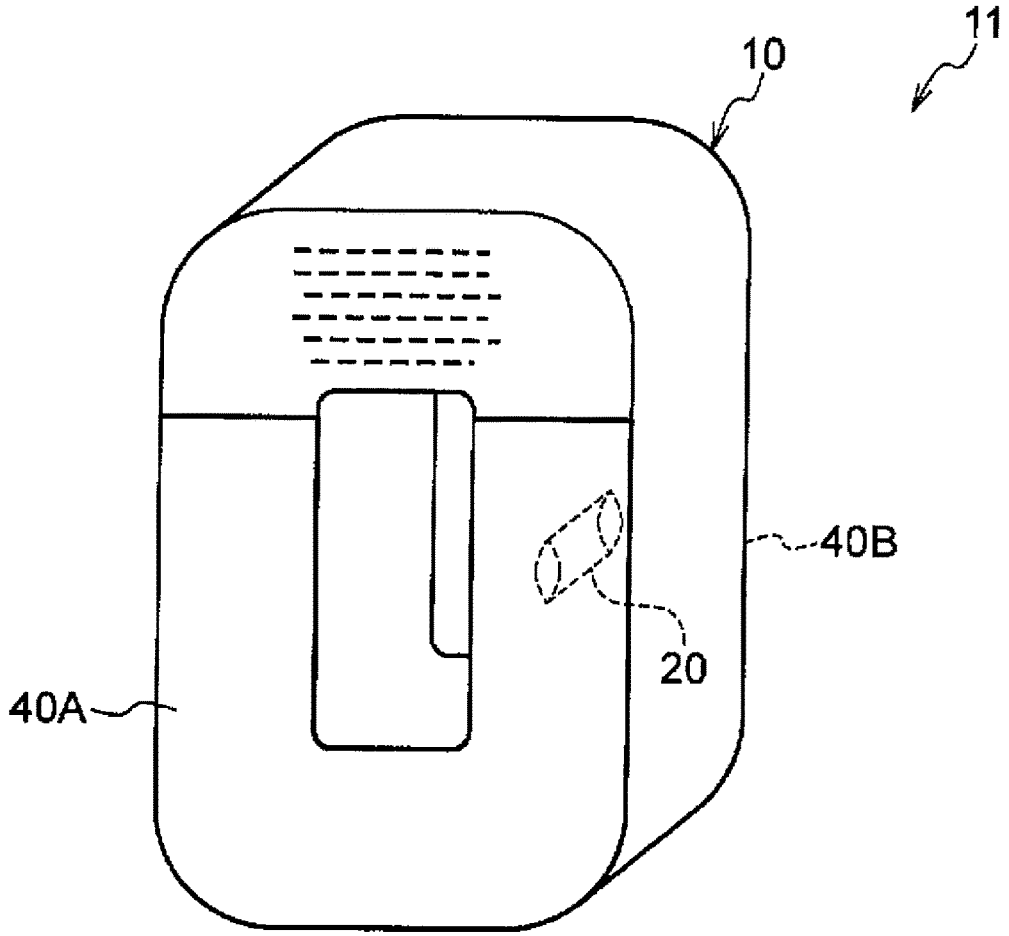
FIG. 5 is a schematic perspective view of a magnetic core according to a modified example of a first embodiment.
Figure 6:
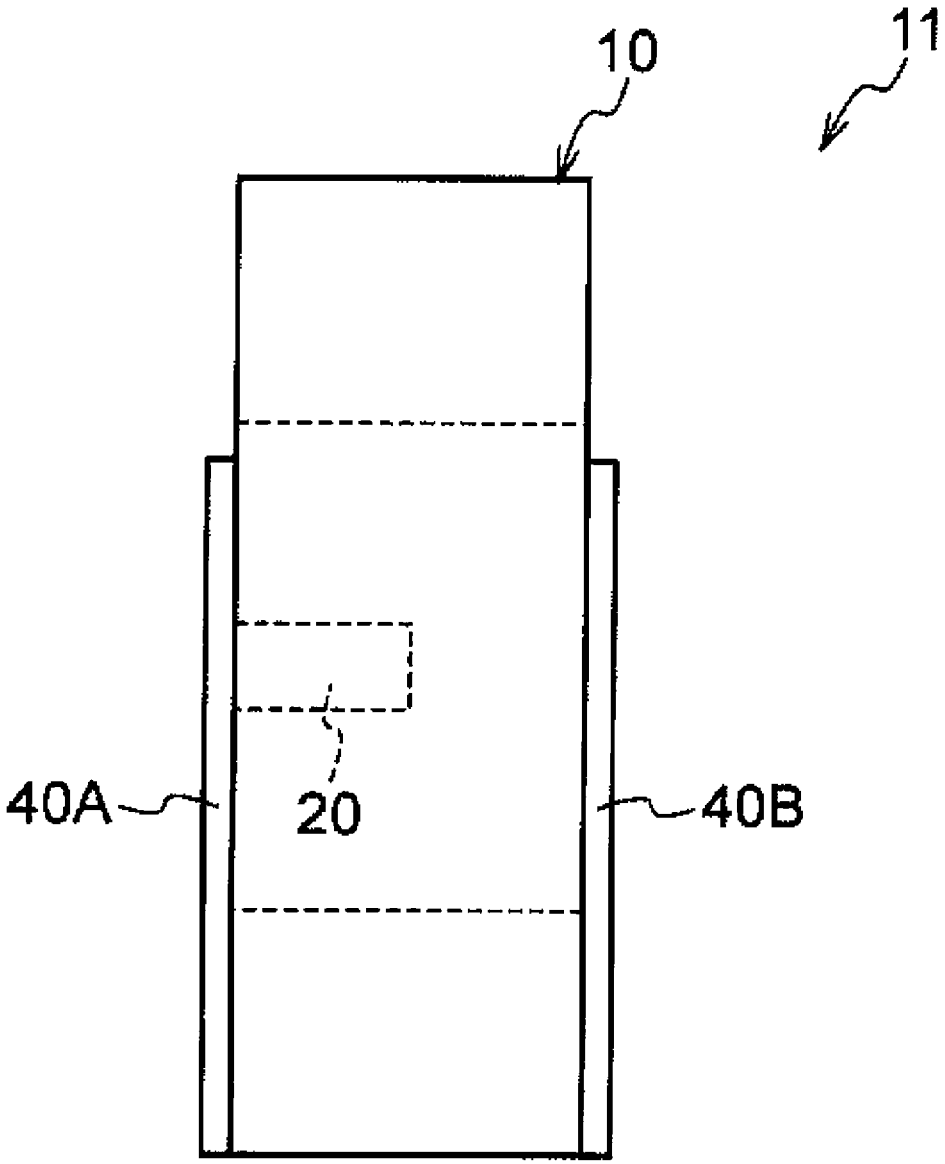
FIG. 6 is a schematic side view of a magnetic core according to a modified example of a first embodiment.

In addition, as illustrated in FIG. 5 and FIG. 6, it is preferable that the magnetic core according to the first embodiment be equipped with a resin layer which blocks the hole and covers at least a part of one end face of the layered body.

FIG. 5 is a schematic perspective view of the magnetic core according to a modified example of the first embodiment, and FIG. 6 is a schematic side view of the magnetic core according to this modified example.

As illustrated in FIG. 5 and FIG. 6, a magnetic core 11 according to the modified example is equipped with a resin layer 40A which covers a part of one end face 12 of the layered body 10 described above. The resin layer 40A blocks the entrance of the hole 20.

The magnetic core 11 according to this modified example is further equipped with a resin layer 40B on a part of another end face 14 of the layered body 10 as well.

The resin layer 40A and the resin layer 40B are layers having a function to protect one end face and another end face of the layered body, a function to flatten one end face and another end face of the layered body, and the like. The resin layer 40A and the resin layer 40B are provided at a part of the region other than the overlap portion 30.

However, the resin layer may be provided over the entire one end face including the overlap portion and the entire another end face including the overlap portion.

Among the resin layer 40A and the resin layer 40B, the resin layer 40A that blocks the entrance of the hold 20 also functions to prevent the metal powder generated in the hold 20 from scattering.

As the resin contained in the resin layer, an epoxy resin is particularly preferable from the viewpoints of heat resistance, electrical insulation, adhesive property, and the like.

The resin layer can be formed, for example, by coating a resin composition containing a resin and a solvent.

Second Embodiment

The magnetic core in the second embodiment of the invention is an example of a magnetic core called "three-phase core" (or "three-phase tripod core").

Figure 7:
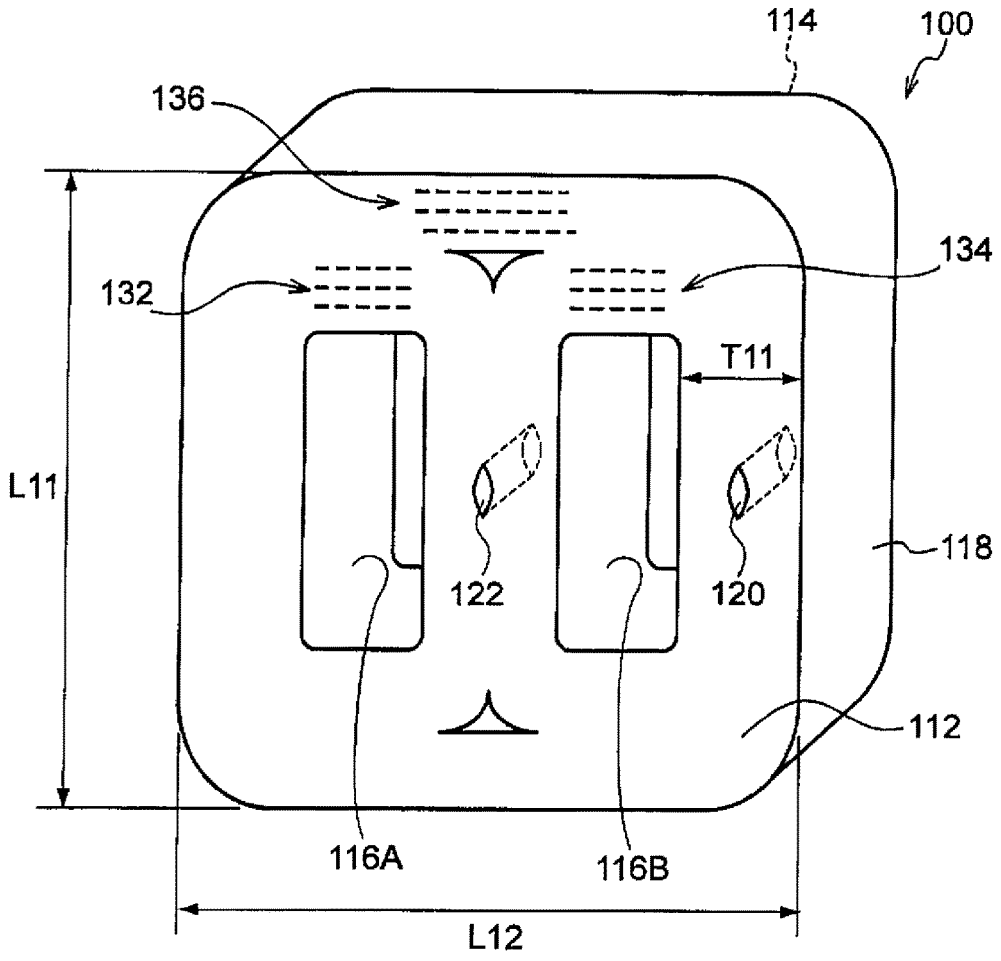
FIG. 7 is a schematic perspective view of a core (layered body) according to a second embodiment.

FIG. 7 is a schematic perspective view of the magnetic core (laminated body) in the second embodiment of the invention.

As illustrated in FIG. 7, a layered body 100 which is the magnetic core of the invention in the second embodiment is also formed by layering amorphous alloy thin strips (layered structure is not illustrated) one on another, and it is a rectangular layered body having one end face 112 and another end face 114 in the width direction of the amorphous alloy thin strips and an outer peripheral surface 118 as the layered body 10.

However, the layered body 100 is different from the layered body 10 in that it has two inner peripheral surfaces (an inner peripheral surface 116A and an inner peripheral surface 116B).

The structure of the layered body 100 is a structure in which two single-phase cores such as the layered body 10 are aligned and surrounded by a bundle of thin strips. The layered body 100 has overlap portions 132 and 134 at the portions of two single-phase cores and an overlap portion 136 at the portion of the bundle of thin strips surrounding the two single-phase cores.

The layered body 100 is also provided with a hole 120 and a hole 122 each of which passes through from a part of the one end face 112 as the starting point, and the width direction of the thin strips corresponds to the depth direction thereof.

By providing these holes, it is possible to easily optimize the heat treatment condition in the same manner as in the case of the layered body 10.

Incidentally, either of the hole 120 or the hold 122 may be omitted.

For preferred aspects (shape, position, depth, size, and the like) of the holes (the holes 120 and 122) in the layered body 100, it is possible to appropriately see the preferred aspects of the layered body 10.

In addition, a resin layer such as the resin layer 40A and the resin layer 40B as described before may also be provided on the laminated body 100.

The thickness T11 of the layered body 100 is preferably from 10 mm to 300 mm, more preferably from 10 mm to 200 mm, still more preferably from 20 mm to 200 mm, and particularly preferably from 40 mm to 200 mm.

The length (length L11 and length L12) of one side of the layered body 100 is preferably from 180 mm to 1380 mm and more preferably from 460 mm to 500 mm.

Other preferred aspects and modified examples of the layered body 100 are the same as the preferred aspects and modified examples of the layered body 10.

As a method of manufacturing the magnetic core of the invention, the method of manufacturing a magnetic core of the invention to be described below is preferable.

<Method of Manufacturing Amorphous Alloy Magnetic Core>

The method of manufacturing an amorphous alloy magnetic core of the invention (hereinafter, also referred to as the "manufacturing method of the invention") includes a layered body preparing step of preparing a layered body which is formed by layering amorphous alloy thin strips one on another and has one end face and another end face in a width direction of the amorphous alloy thin strips and an inner peripheral surface and an outer peripheral surface orthogonal to the layering direction of the amorphous alloy thin strips, and a hole forming step of forming a hole passing through from the one end face of the layered body as a starting point and the width direction corresponding to a depth direction of the hole.

According to the manufacturing method of the invention, it is possible to fabricate an amorphous alloy magnetic core which has a hole for measuring the internal temperature and for which the heat treatment condition is easily optimized.

Hereinafter, the respective steps in the manufacturing method of the invention will be described.

<Layered Body Preparing Step>

The layered body preparing step is a step of preparing a layered body which is formed by layering thin strips one on another, the layered body having one end face and another end face in the width direction of the amorphous alloy thin strips and an inner peripheral surface and an outer peripheral surface orthogonal to the layering direction of the amorphous alloy thin strips.

The layered body to be prepared in the present step is a main constituent member of the amorphous alloy magnetic core manufactured by the manufacturing method of the invention.

The present step is a convenient step and may be a step of manufacturing a layered body or a step of simply preparing a layered body which has been already manufactured.

In addition, the layered body preparing step may be a step of preparing a composite of the layered body and at least either of the inner peripheral surface side silicon steel plate or the outer peripheral surface side silicon steel plate.

As a method of manufacturing the layered body or the composite, a known method of manufacturing an amorphous alloy magnetic core can be applied.

Incidentally, for the method of manufacturing an amorphous alloy magnetic core and the structure of an amorphous alloy magnetic core, for example, it is possible to see "Characteristics and magnetic properties of amorphous core for energy-saving transformer" (internet <URL: http://www.hitachi-metals.co.jp/products/infr/en/pdf/hj-b13-a.pdf).

<Hole Forming Step>

The hole forming step is a step of forming a hole passing through from the one end face (one end face in the width direction of the thin strips) of the layered body as the starting point, and the width direction (width direction of the thin strips) corresponding to the depth direction of the hole.

The method of forming a hole is not particularly limited, but a method of forming a hole by a method to insert a bar-like member from one end face of the layered body is preferable from the viewpoint of decreasing the influence on the magnetic properties of the magnetic core. In this method, a hole is formed as the interval between a thin strip and another thin strip is partially expanded by the bar-like member inserted.

As the shape of the bar-like member, a bar shape having a pointed tip portion is suitable. In this aspect, the bar-like member can be inserted into one end face of the layered body from the pointed tip portion side, and it is thus easy to expand a part between the thin strips (that is, it is easy to form a hole).

As the material for the bar-like member, a highly rigid material is preferable, and examples thereof may include a metal and ceramics.

The diameter of the bar-like member can be appropriately selected in consideration of the size of the hole to be formed, and for example, a diameter of from 3 mm to 7 mm may be mentioned.

<Heat Treatment Step>

It is preferable that the manufacturing method of the invention further include a heat treatment step of subjecting the layered body, after being subjected to the hole forming step, to a heat treatment while measuring the internal temperature of the hole.

This makes it easier to optimize the heat treatment condition.

The measurement of the internal temperature of the hole (namely, the internal of the magnetic core) can be conducted by using a temperature measuring unit such as a thermocouple as described above.

As the thermocouple, a sheath type thermocouple is suitable.

The diameter of the thermocouple can be appropriately selected in consideration of the width of the hole.

The heat treatment can be conducted by using a known heat treating furnace.

The heat treatment condition can be appropriately set in consideration of the material for the thin strip, the degree of intended magnetic properties, and the like.

Examples of the heat treatment condition may include a condition in which the maximum temperature reached in the hole (namely, in the magnetic core) is in a range of higher than 300° C. and equal to or lower than a temperature tp that is lower by 150° C. than the crystallization starting temperature of the amorphous alloy.

It is easy to remove distortion of the thin strips and to impart excellent magnetic properties to the magnetic core when the maximum reached temperature exceeds 300° C.

It is easy to maintain the amorphous state of the thin strips and to obtain excellent magnetic properties when the maximum reached temperature is equal to or lower than the temperature tp.

In addition, the maximum reached temperature may be higher than 300° C. and equal to or lower than 370° C., or may be equal to or higher than 310° C. and equal to or lower than 370° C.

Here, the crystallization starting temperature of the amorphous alloy is a temperature measured by using a differential scanning calorimeter (DSC) as a heat generation starting temperature when the temperature of the amorphous alloy thin strips is raised under a condition of 20° C./min from room temperature.

In addition, as the heat treatment condition, a condition in which the retention time at the preferred maximum reached temperature described above is from 1 hour to 6 hours is more preferable.

It is possible to suppress variations in magnetic properties among the individual magnetic cores when the retention time in the above state is 1 hour or longer.

It is easy to maintain the amorphous state of the thin strips when the retention time in the above state is 6 hours or shorter.

<Resin Layer Forming Step>

It is preferable that the manufacturing method of the invention further include a resin layer forming step of forming a resin layer which blocks the hole and covers at least a part of the one end face of the layered body after being subjected to the heat treatment step.

It is possible to suppress scattering of the crushed powder from the hole by the resin layer even in a case in which a crushed powder of the amorphous alloy is generated in the hole in the hole forming step.

The resin layer can be formed, for example, by coating a resin composition containing a resin (preferably an epoxy resin) and a solvent. As a resin composition, a two-liquid mixed type resin composition can also be used.

The manufacturing method of the invention may have steps other than the above steps. Examples of other steps may include a step known as a manufacturing step of an amorphous alloy magnetic core.

EXAMPLES

Hereinafter, Examples of the invention will be described, but the invention is not limited to the following Examples.

<Preparation of Amorphous Alloy Thin Strip>

A long amorphous alloy thin strip having a thickness of 25 μm and a width of 170 mm was prepared through continuous roll casting by a single roll method.

The composition of the amorphous alloy thin strip thus prepared is $Fe_{81.7}Si_2B_{16}C_{0.3}$ (the suffix represents atomic % of each element).

<Fabrication of Amorphous Alloy Magnetic Core (Core)>

A magnetic core (core) was fabricated by using the amorphous alloy thin strip.

The configuration of the magnetic core (core) was a configuration of a composite composed of an inner peripheral surface side silicon steel plate, the layered body 10 described above, and an outer peripheral surface side silicon steel plate. The details will be described below.

First, 30 sheets of the first alloy thin strip obtained by cutting the amorphous alloy thin strip into a length of 700 mm in the longitudinal direction were prepared.

Furthermore, 30 sheets of the second alloy thin strip obtained by cutting the amorphous alloy thin strip so as to have a length in the longitudinal direction that is 5.5 mm longer than the length in the longitudinal direction of the first alloy thin strip were prepared.

In the same manner, 30 sheets of the $(n+1)^{th}$ alloy thin strip obtained by cutting the amorphous alloy thin strip so as to have a length in the longitudinal direction that is 5.5 mm longer than the length in the longitudinal direction of the $n^{th}$ alloy thin strip were prepared, respectively (here, n is an integer from 2 to 84).

Furthermore, a directional silicon steel plate (plate thickness: 0.27 mm, plate width: 170 mm) cut into a length of 1300 mm in the longitudinal direction was prepared.

Next, the first to the 85th alloy thin strips (30 sheets for each) were layered in this order, and the directional silicon steel plate was further superposed on the side of the 85th alloy thin strips. At this time, the alloy thin strips were layered so that both end portions in the width direction of the directional silicon steel plate and both end portions of the respective alloy thin strips (2550 sheets in total) overlapped each other.

Next, 30 sheets of the first alloy thin strips were bent in an annular shape (toroidal shape) such that the both end portions in the longitudinal direction thereof overlapped each other by from 15 mm to 25 mm while maintaining the state in which the positions of the respective alloy thin strips and the directional silicon steel plate were fixed so that they do not move.

Next, 30 sheets of the second alloy thin strips were bent into an annular shape such that the both end portions in the longitudinal direction thereof overlapped each other by from 15 mm to 25 mm.

This operation was sequentially conducted in the same manner for the third to 84th alloy thin strips (30 sheets for each) as well.

Next, 30 sheets of the 85th alloy thin strips were bent in an annular shape such that the both end portions in the longitudinal direction thereof overlapped each other by from 10 mm to 20 mm.

Next, the directional silicon steel plate, which is to be the outermost periphery, was bent into an annular shape such that it followed along the 30 sheets of the 85th alloy thin strips bent into an annular shape and such that the both end portions in the longitudinal direction thereof overlapped each other, and the overlapped both end portions in the longitudinal direction were fixed with a heat-resistant tape. At this time, the position at which the directional silicon steel plate overlapped was the position at which the both end portions in the longitudinal direction of the 30 sheets of the 85th alloy thin strips overlapped each other by from 10 mm to 20 mm.

Finally, the diameter of the ring of the first to 84th alloy thin strips bent into an annular shape was expanded so as to follow along the 85th alloy thin strips, and the first to 84th alloy thin strips all thus overlapped each other by from 10 mm to 20 mm.

An annular first composite including an annular layered body formed by layering amorphous alloy thin strips one on another and an annular outer peripheral surface side silicon steel plate was thus obtained.

The annular (toroidal shape) magnetic core thus obtained was molded by using a molding jig so as to have a rectangular annular shape as illustrated in FIG. 1 and fixed. At this time, a rectangular annular directional silicon steel plate (plate thickness: 0.27 mm, plate width: 170 mm) as the inner peripheral surface side silicon steel plate was fitted into the innermost periphery (the first alloy thin strip side) of the magnetic core.

A rectangular annular magnetic core having a long side length of the outer periphery of the magnetic core (length in the longitudinal direction of the magnetic core) of 418 mm and a short side length of the outer periphery of the magnetic core (length in the direction orthogonal to the longitudinal direction of the magnetic core) of 236 mm was thus obtained.

In this magnetic core, the sum of the thickness in the layering direction of the layered body (the thickness T1 in FIG. 2), the thickness of the inner peripheral surface side silicon steel plate, and the thickness of the outer peripheral surface side silicon steel plate was 73 mm.

Next, a metal bar having a diameter of 5 mm and having a pointed tip was inserted into the position that was on the center line of the long side length (the position bisecting the long side length; on the center line C2 in FIG. 2) and the center line in the layering direction (the position equally distant from the inner peripheral surface and the outer peripheral surface; on the center line C1 in FIG. 2) on the long side portion of one end face (one end face in the width direction of the amorphous thin strips, of the magnetic core) of the magnetic core in a state of being fixed by the molding jig in a direction perpendicular to one end face of the magnetic core. The interval between one thin strip and another thin strip was thus partially expanded and a hole for thermocouple insertion was formed. The depth of this hole was set to 85 mm (half of the width of the thin strips). Incidentally, this hole is entirely included in a range (the range X1 indicated by an oblique line in FIG. 2) from one end to another end in the longitudinal direction of the inner peripheral surface on the one end face, when viewed from the side of one end face.

Thus the magnetic core in which the hole has been formed was obtained (hereinafter, referred to as "Core 1").

Three cores (hereinafter, referred to as "Core 2", "Core 3", and "Core 4") were further fabricated in the same manner as the fabrication of Core 1 described above.

Next, a sheath type thermocouple having a diameter of 1.6 mm was inserted into the hole in a state in which the metal bar was inserted to each of Cores 1 to 4, thereafter the metal bar was removed therefrom.

<Heat Treatment>

Cores 1 to 4 in a state in which the sheath type thermocouple was inserted to Cores 1 to 4 and Cores 1 to 4, respectively, were fixed by the molding jig were placed in one heat treating furnace. As the heat-treating furnace, a heat-treating furnace equipped with a heater for heating at the upper portion and a mechanism for air circulation of the interior was used.

Next, the heat treatment of Cores 1 to 4 was simultaneously conducted while measuring the internal temperature of the hole for each of Cores 1 to 4 by the thermocouples.

The heat treatment was conducted in a magnetic field generated by disposing a conducting wire at the center (the center of the inner periphery) of the respective magnetic cores so that a magnetic flux is generated in the closed magnetic path direction of the respective magnetic cores and allowing a direct current of 1,800 A to flow through the conducting wire.

The condition for the heat treatment described above was a condition in which the following operations of Step 1 to Step 4 were sequentially carried out (see FIG. 8 and FIG. 9 to be described later).

Step 1 . . . the air was circulated in the furnace, the temperature was raised to have a furnace temperature of 340° C., and the operation was shifted to Step 2 at the stage at which the internal temperature of the magnetic core (the temperature measured by the thermocouple, the same applies hereinafter) reached 310° C. or higher in all the magnetic cores.

Step 2 . . . the temperature was lowered to have a furnace temperature of 330° C. while circulating the air in the furnace, and the operation was shifted to Step 3 at the stage at which the internal temperature of the magnetic core (the temperature measured by the thermocouple, the same applies hereinafter) reached 315° C. or higher in all the magnetic cores.

Step 3 . . . the temperature was lowered to have a furnace temperature of 320° C. and kept for 70 minutes.

Step 4 . . . the temperature was lowered to have a furnace temperature of 0° C., and the air was sent into the furnace by using a fan. The heat treatment was terminated at the stage at which the internal temperature of the magnetic core reached 200° C. or lower in all the magnetic cores, the door of the heat-treating furnace was opened, and Cores 1 to 4 were taken out from the heat-treating furnace.

The thermocouple was pulled out from each of Cores 1 to 4 after Cores 1 to 4 were taken out from the heat-treating furnace.

In Cores 1 to 4, the width (width Wh in FIG. 3) of the hole from which the thermocouple was pulled out was 2.5 mm, and the length (length Lh in FIG. 3) of the hole was 20 mm, respectively.

<Coating and Curing of Resin>

The epoxy resin composition 1 was coated on a part (a region including the hole) of the one end face of Core 1 and cured to form an epoxy resin layer. Thereafter, the molding jig was removed from Core 1.

As the epoxy resin composition, a two-liquid mixed type epoxy resin composition 1 manufactured by Meiden Chemical Co., Ltd was used.

Here, the epoxy resin composition 1 is composed of the liquid A having the following composition and the liquid B having the following composition. In the epoxy resin composition 1, the mixing mass ratio (liquid A:liquid B) of the liquid A to the liquid B is 100:23, and the viscosity (25° C.) after mixing of the liquid A and the liquid B is 45 Pa·s, and the thixotropy index value (T. I. value) is 1.9.

—Composition of Liquid A—

The composition of liquid A is a composition obtained by adjusting the following components to be 100% by mass in total.

| | |
|---|---|
| Semi-solid epoxy resin (CAS No. 25068-38-6) | from 25 to 35% by mass |
| Side chain type epoxy resin (CAS No. 36484-54-5) | from 35 to 45% by mass |
| Silica (CAS No. 14808-60-7) | from 25 to 35% by mass |
| Pigment and others (CAS No. 67762-90-7, 13463-67-7, 1333-86-4) | less than 5% by mass |

—Composition of Liquid B (100% by Mass in Total)—

| | |
|---|---|
| Modified aliphatic polyamine (CAS No. 39423-51-3 and others) | 81% by mass |
| Isophoronediamine (CAS No. 2855-13-2) | 19% by mass |

<Evaluation on Magnetic Properties>

Next, a conducting wire having a cross-sectional area of 2 $mm^2$ as a primary winding wire was wound around the Core 1 in which the epoxy resin layer has been formed described above by 10 turns and the conducting wire as a secondary winding wire was wound therearound by 2 turns, to obtain a wound magnetic core.

Thus obtained wound magnetic core was subjected to an evaluation on the core loss (W/kg) and apparent power (VA/kg) at 1.4 T and 60 Hz.

As a result, the core loss was 0.26 W/kg and the apparent power was 0.48 VA/kg.

In this manner, favorable magnetic properties were imparted to the Core 1 by the heat treatment under the condition described above.

Figure 8:
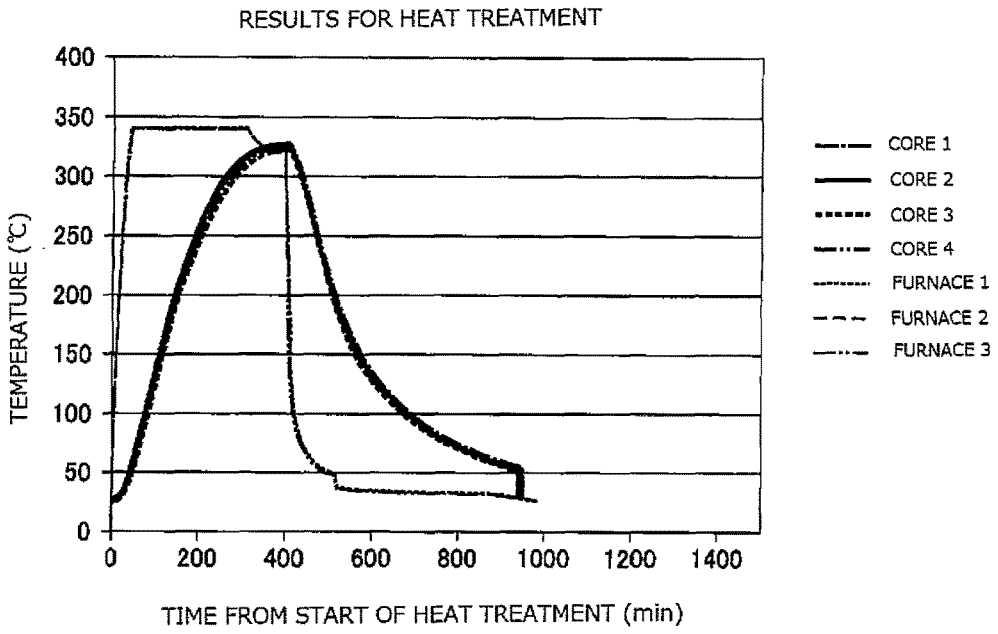
FIG. 8 is a graph illustrating the relation between the elapsed time (minutes) from the start of a heat treatment and the temperatures of a core and a furnace in Example 1.

FIG. 8 is a graph illustrating the relation between the elapsed time (minutes) from the start of the heat treatment and the temperatures of the magnetic core and the furnace under the heat treatment condition described above, and FIG. 9 is a partially enlarged view of FIG. 8.

Figure 9:
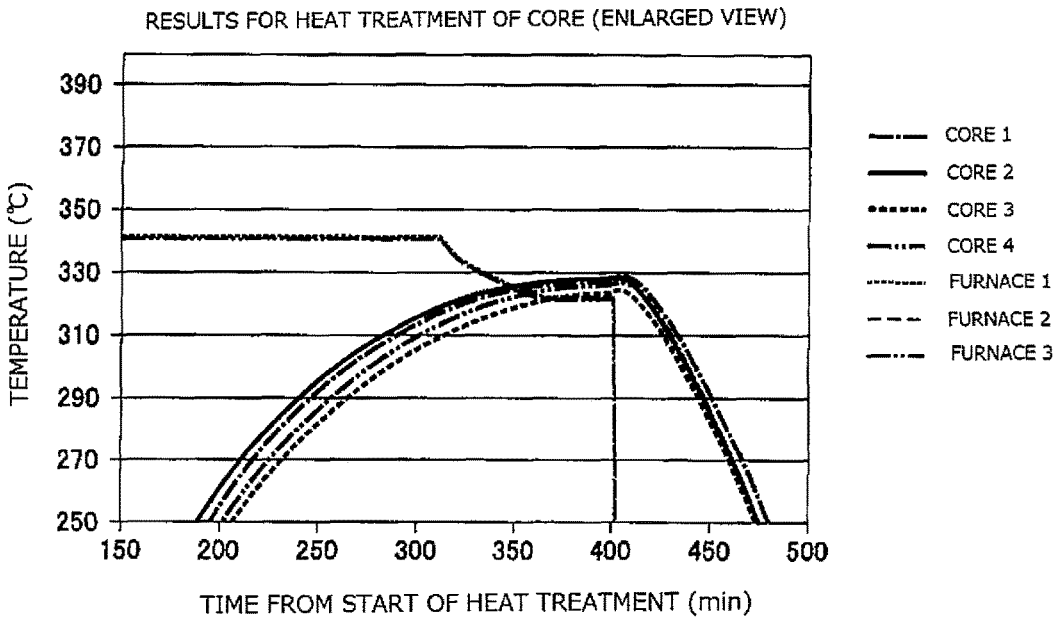
FIG. 9 is a partially enlarged view of FIG. 8.

In FIG. 8 and FIG. 9, the Cores 1 to 4 respectively represent the internal temperature of the Cores 1 to 4 (the temperature measured by the thermocouple), and the furnaces 1 to 3 represent the temperature at three points in the heat treating furnace.

As illustrated in FIG. 8 and FIG. 9, it was confirmed that the internal temperature profiles of the Cores 1 to 4 were almost consistent with one another in the course of the heat treatment. Consequently, it was confirmed that the Cores 2 to 4 were subjected to a proper heat treatment for imparting favorable magnetic properties as in the same manner as in the case of Core 1.

From the results described above, an effect is expected that it is possible to adjust the heat treatment condition while measuring the internal temperature of the core, that is, it is possible to easily optimize the heat treatment condition by providing the core with a hole for thermocouple insertion.

<Fabrication and Evaluation of Core (Core 11) Having Another Shape>

Next, Core 11 having a shape different from those of Cores 1 to 4 was fabricated and evaluated. The details will be described below.

Core 11 was fabricated in the same manner as the fabrication of Core 1 except that the width of the amorphous alloy thin strip, the plate width of the outer peripheral side silicon steel plate, and the plate width of the inner peripheral side silicon steel plate were set to 142 mm, respectively, the long side length of the outer periphery of the magnetic core (length in the longitudinal direction of the magnetic core) was set to 302 mm, the short side length of the outer periphery of the magnetic core (the length in the direction orthogonal to the longitudinal direction of the magnetic core) was set to 164 mm, and the sum of the thickness (the thickness T1 in FIG. 2) in the layering direction of the layered body, the thickness of the inner peripheral surface side silicon steel plate, and the thickness of the outer peripheral surface side silicon steel plate was set to 53 mm by adjusting the number of thin strips.

Core 11 thus fabricated was subjected to the heat treatment, the coating and curing of resin, and the evaluation on magnetic properties in the same manner as Core 1 except that the kind of the epoxy resin composition in the coating and curing of resin was changed.

In the coating and curing of resin on Core 11 a two-liquid mixed type epoxy resin composition 2 manufactured by Meiden Chemical Co., Ltd was used.

The epoxy resin composition 2 is composed of the liquid A having the following composition and the liquid B having the following composition. In the epoxy resin composition 2, the mixing mass ratio (liquid A:liquid B) of the liquid A to the liquid B is 100:25, and the viscosity (25° C.) after mixing of the liquid A and the liquid B is 51 Pa·s, and the thixotropy index value (T. I. value) is 2.7.

—Composition of Liquid A—

The composition of liquid A is a composition obtained by adjusting the following components to be 100% by mass in total.

| | |
|---|---|
| Semi-solid epoxy resin (CAS No. 25068-38-6) | from 25 to 35% by mass |
| Side chain type epoxy resin (CAS No. 36484-54-5) | from 40 to 50% by mass |
| Silica (CAS No. 14808-60-7) | from 20 to 30% by mass |
| Pigment and others (CAS No. 67762-90-7, 13463-67-7, 1333-86-4) | less than 5% by mass |

—Composition of Liquid B (100% by Mass in Total)—

| | |
|---|---|
| Modified aliphatic polyamine (CAS No. 39423-51-3 and others) | 81% by mass |
| Isophoronediamine (CAS No. 2855-13-2) | 19% by mass |

As a result for evaluation on the magnetic properties, the core loss was 0.26 W/kg and the apparent power was 0.48 VA/kg in Core 11.

As described above, it was confirmed that the heat treatment condition for Core 1 was also a proper condition for Core 11 having a different size.

The disclosure of Japanese Patent Application No. 2014-197345 is incorporated herein by reference in its entirety.

All documents, patent applications, and technical standards described in this specification are incorporated herein by reference to the same extent as if specifically and individually indicated as individual document, patent application, and technical standard are incorporated by reference.

The invention claimed is:

1. A method of manufacturing an amorphous alloy magnetic core, the method comprising:

a layered body preparing step of preparing a layered body by layering amorphous alloy thin strips one on another, the layered body having one end face and another end face in a width direction of the amorphous alloy thin strips and an inner peripheral surface and an outer peripheral surface orthogonal to a layering direction of the amorphous alloy thin strips; and a hole forming step of forming a hole passing through from the one end face of the layered body as a starting point, the width direction corresponding to a depth direction of the hole, a depth of the hole being from 30% to 70% with respect to a distance between the one end face and the another end face, and a width of the hole being narrower than a value calculated by a mathematical formula $T\times(100-LF)/100$, wherein a thickness (mm) of the layered body is denoted as T and a space factor (%) of the amorphous alloy magnetic core is denoted as LF in the layered body.

2. The method of manufacturing an amorphous alloy magnetic core according to claim 1, the method further comprising:

a heat treatment step of subjecting the layered body, after being subjected to the hole forming step, to a heat treatment while measuring an internal temperature of the hole.

3. The method of manufacturing an amorphous alloy magnetic core according to claim 2, the method further comprising:

a resin layer forming step of forming a resin layer which blocks the hole and covers at least a part of the one end face of the layered body after being subjected to the heat treatment step.

* * * * *